US005346098A

United States Patent [19]

King et al.

[11] Patent Number: 5,346,098

[45] Date of Patent: Sep. 13, 1994

[54] DEVICES FOR DISPENSING LIQUID

[75] Inventors: Alan M. King, Westmount; Orn Arnason, Quebec, both of Canada

[73] Assignee: VKI Technologies, Inc., Saint-Hubert, Canada

[21] Appl. No.: 136,872

[22] Filed: Oct. 18, 1993

[51] Int. Cl.[5] ..... B67D 5/62; B67D 5/30

[52] U.S. Cl. ..... 222/146.5; 222/67; 222/513; 222/639

[58] Field of Search ..... 222/64, 67, 146.5, 504, 222/512, 513, 514, 544, 559, 561, 639

[56] References Cited

U.S. PATENT DOCUMENTS 3,179,035 4/1965 Lockett .
3,216,623 11/1965 Grundmann .
3,311,266 3/1967 Ward .
4,688,699 8/1987 Goudy, Jr. et al. ..... 222/67 X

*Primary Examiner*—Robert P. Olszewski
*Assistant Examiner*—Dean A. Reichard
*Attorney, Agent, or Firm*—Hill, Steadman & Simpson

[57] ABSTRACT

A hot water dispensing device which includes a flexible tube or a bellows which can be depressed by a solenoid such that hot water can pass into the tube or bellows and out an outlet when the solenoid is energized. When the solenoid is de-energized, the upper portion of the tube or bellows forms a seal to prevent water overflowing if the machine is moved or is jolted. By varying the time of energization of the solenoid, the quantity of water can be adjusted. Another modification has a pivoted tube controlled by a solenoid.

15 Claims, 3 Drawing Sheets

FIG. 7
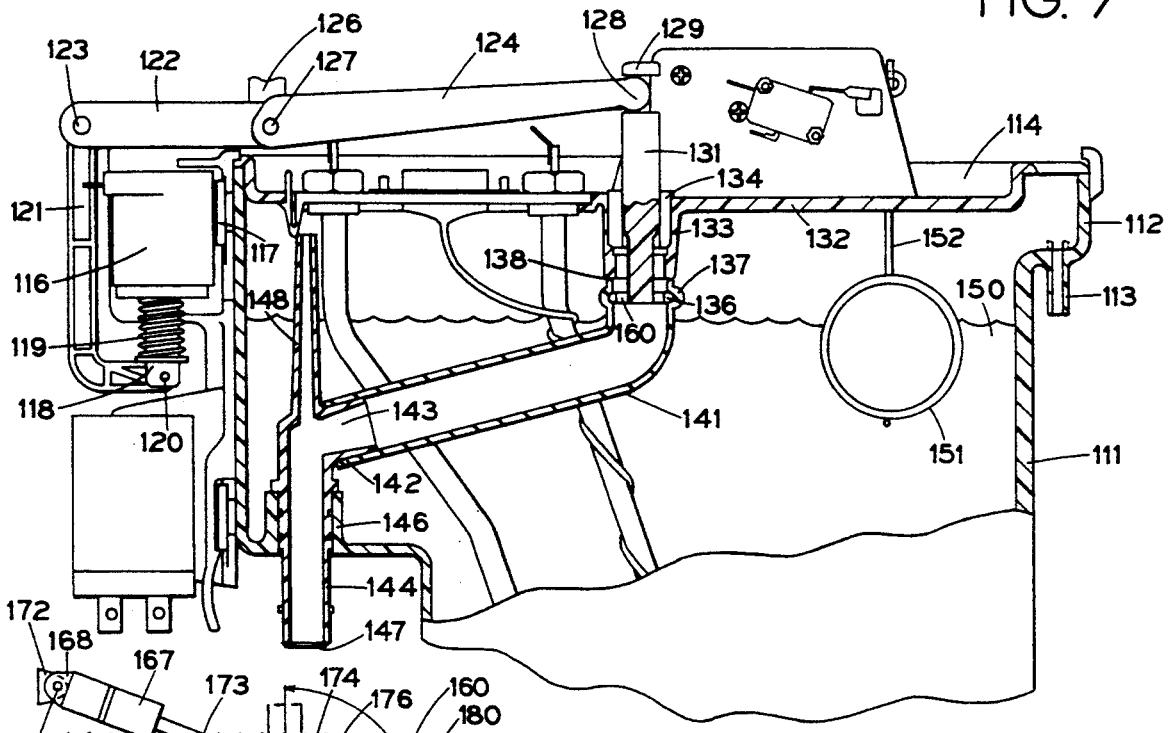
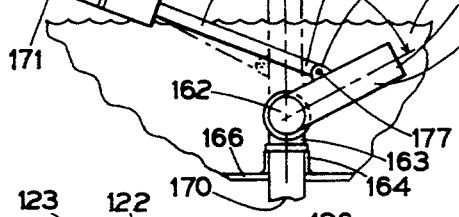
FIG. 9
FIG. 8
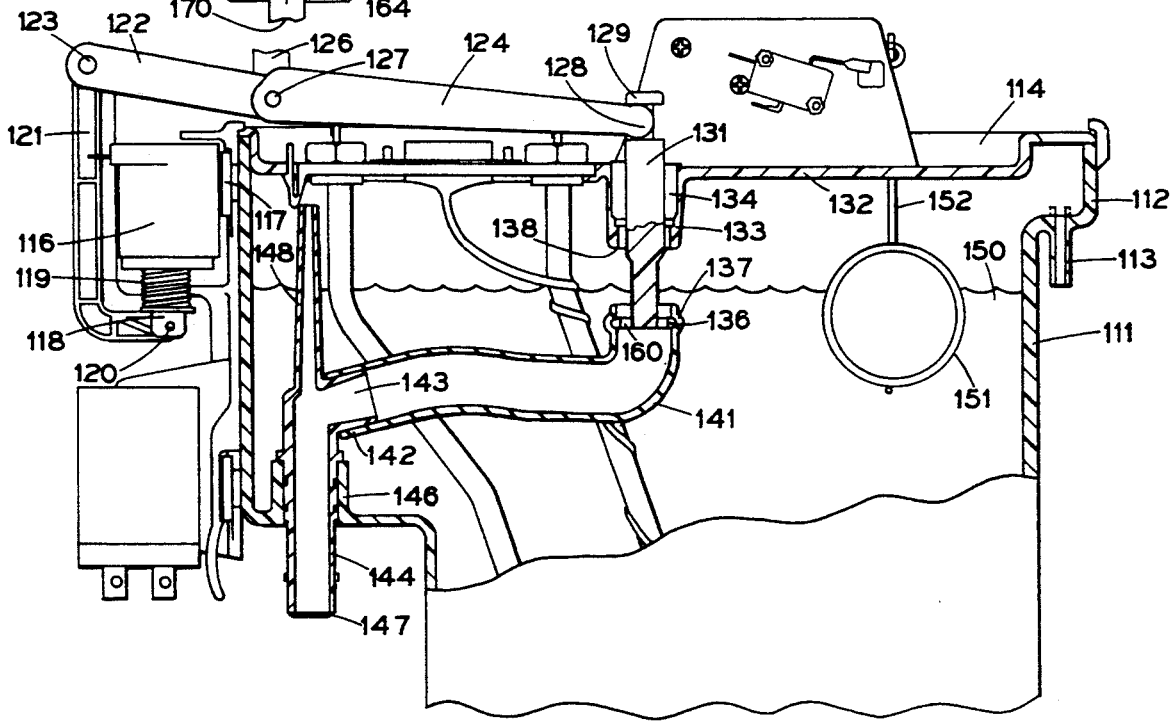

DEVICES FOR DISPENSING LIQUID

BACKGROUND OF THE INVENTION

1. Field of the Invention

This invention relates in general to liquid dispensers and in particular to a hot water dispenser that can be used, for example, in a coffee brewing machine or other device.

2. Description of Related Art

In hot water dispensing mechanisms of the prior art, a solenoid valve has controlled the flow of hot water. However, it is difficult to precisely control the quantity of hot water with such prior art devices. See U.S. Pat. Nos. 3,311,266; 3,216,623 and 3,179,035.

SUMMARY OF THE INVENTION

The present invention relates to means for moving the end of a tube below the level of water in a container so that a quantity of water will be delivered through the tube. The input end of the tube may engage a seal when water is not being delivered so as to prevent accidental discharge. The input end of the tube may be moved vertically below the water level to allow discharge or the tube may be rotated so as to cause the input end of the tube to be moved below the level of the water. The level of the water in the tank may be maintained at a constant level by a float valve and the input end of the tube can be moved by a solenoid below the water level for a fixed time so as to deliver a fixed quantity of water. The tube may be flexible so that it will flex so that its input end can be moved below the surface of the water. The tube may also be rigid and formed with a bend so that it can be rotated or pivoted so as to move the input end of the pipe below the water's surface.

The present invention comprises a bellows tube which is mounted in a container of hot water and which is coupled to a solenoid which when energized depresses the top of the bellows tube below the level of the hot water such that the hot water can pass through openings in the top of the tube through an outlet for dispensing. The time that the solenoid is energized controls the time that the top of the bellows tube is below the water level and thus controls the quantity of hot water which is dispensed. When the solenoid is de-energized, the top of the tube engages a plate which seals it so that hot water will not be discharged from the tube when the unit is moved or jostled because the top of the discharge tube is sealed.

By varying the time of energization of the solenoid, the quantity of hot water dispensed can be adjusted. A float valve or other control device maintains the level of hot water in the container at a constant level. A heater allows the temperature of the hot water to be controlled.

The invention provides a simple and accurate hot water dispenser which can be used for a coffee brewer or other device.

Other objects, features and advantages of the invention will be readily apparent from the following description of certain preferred embodiments thereof taken in conjunction with the accompanying drawings although variations and modifications may be effected without departing from the spirit and scope of the novel concepts of the disclosure, and in which:

BRIEF DESCRIPTION OF THE DRAWINGS

FIG. 7 is a sectional view of a modified form of the invention in the nonenergized condition;

FIG. 8 is a sectional view of the invention of FIG. 7 in the energized condition; and FIG. 9 is a cut-away view of another embodiment.

DETAILED DESCRIPTION OF THE PREFERRED EMBODIMENTS

Figure 1:
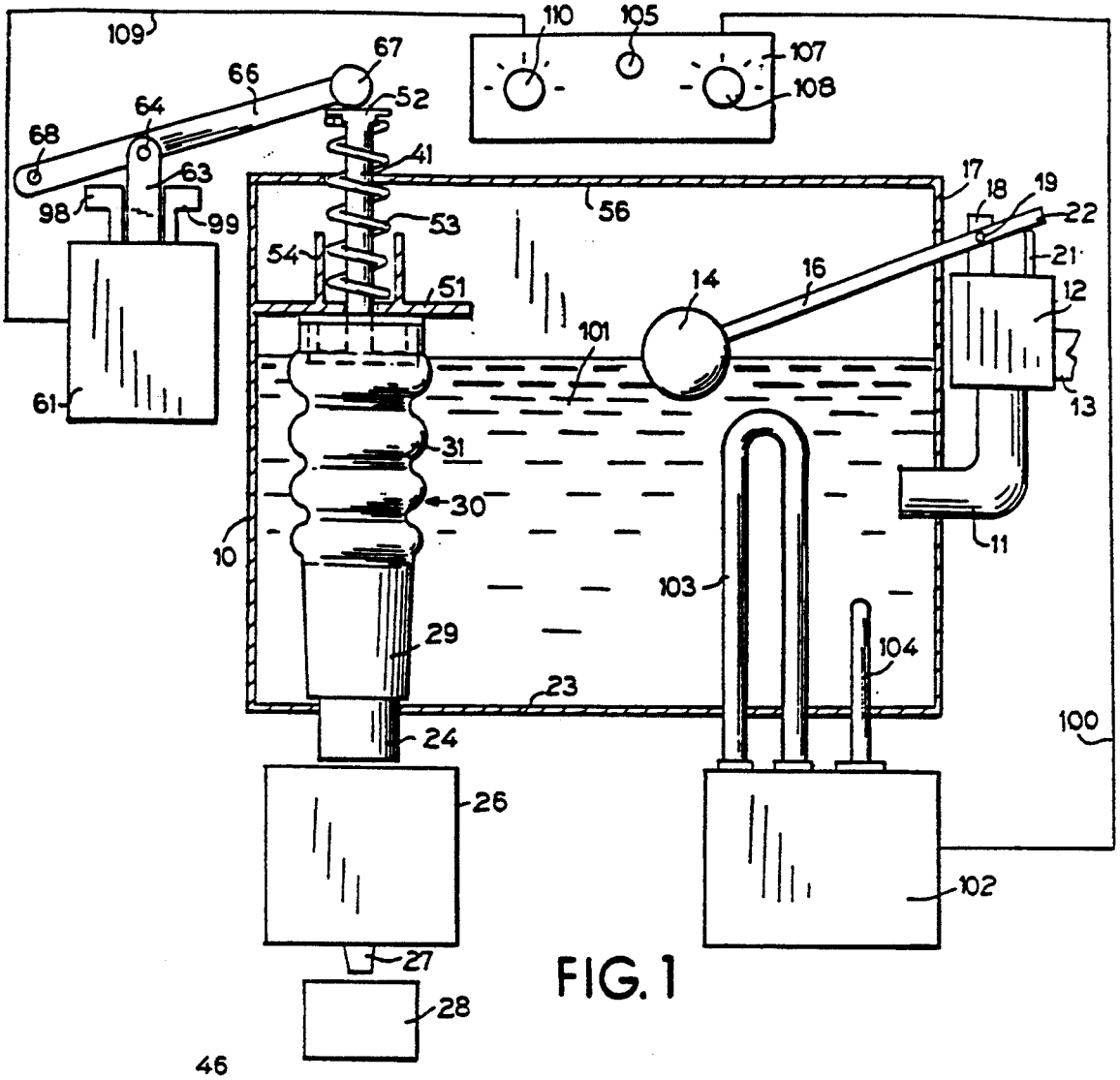
FIG. 1 is a cut-away schematic view illustrating the hot water dispenser of the invention.
Figure 3:
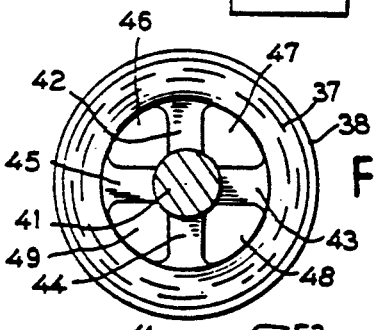
FIG. 3 is a plan view of the top of the bellow tube.
Figure 2:
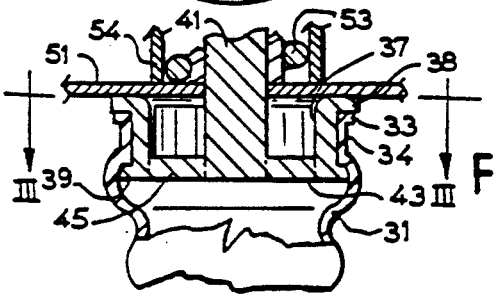
FIG. 2 is a sectional view through the top of the bellows tube.
Figure 4:
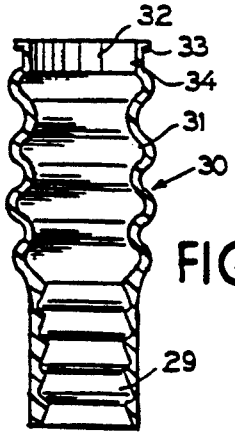
FIG. 4 is a sectional view through the bellows tube.
Figure 6:
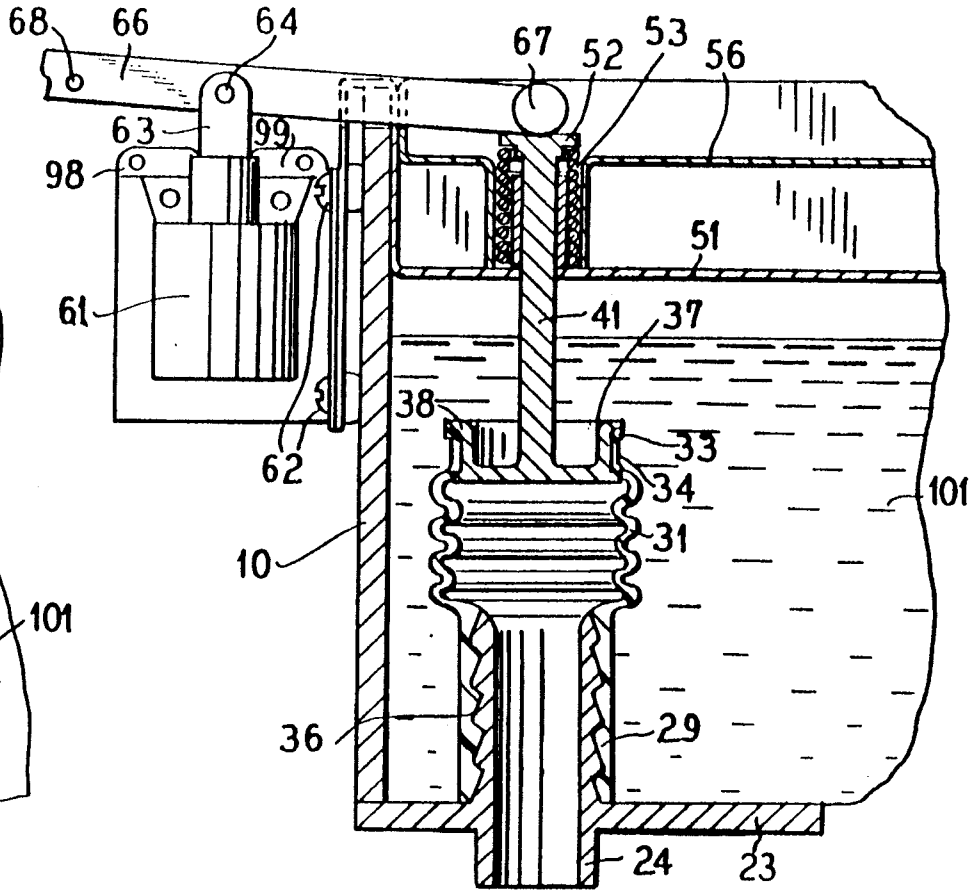
FIG. 6 is a partially cut-away sectional view showing the hot water dispenser in the energized position.
Figure 5:
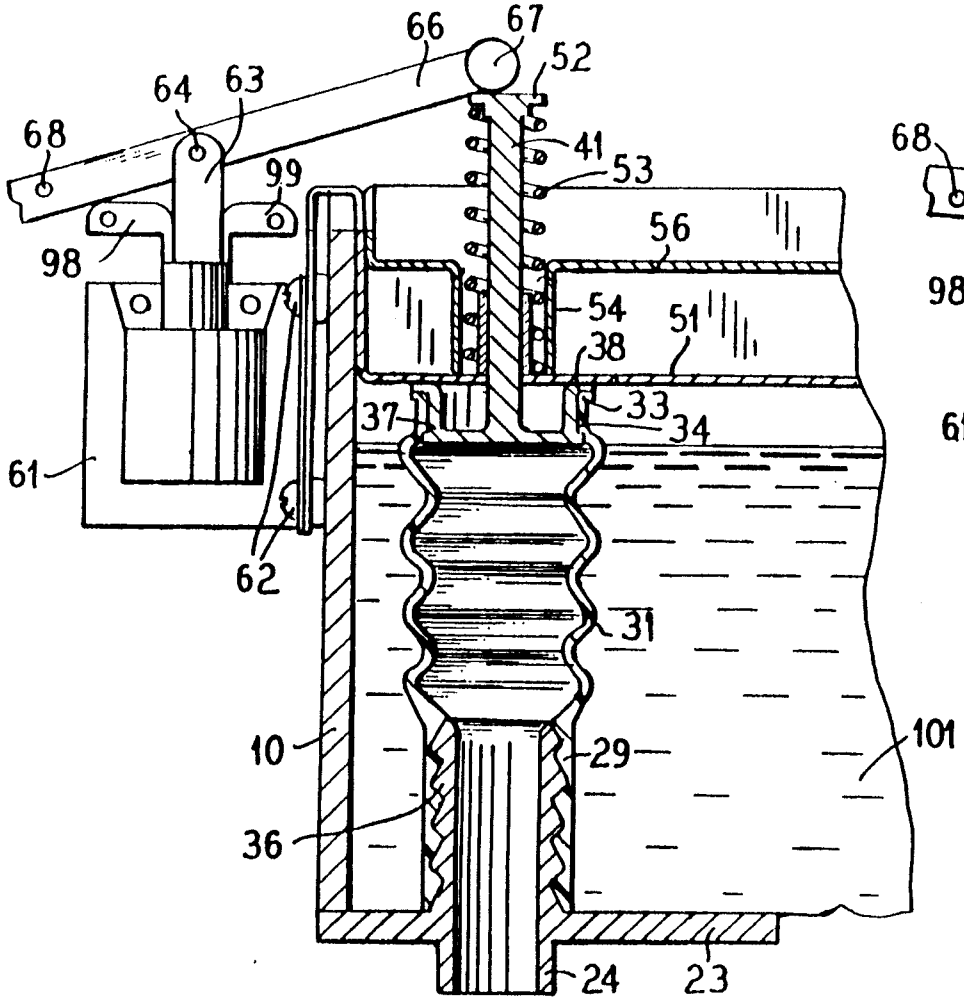
FIG. 5 is a partially cut-away sectional view through the hot water dispenser showing the non-energized condition.

FIGS. 1–6 illustrate a first embodiment of the hot water dispenser of the invention. A container 10 has a bottom wall 23 and a top wall 56 and contains hot water 101 which is heated by heater 102 that has a heating element 103 and a sensor element 104. A water input conduit 13 is connected to a valve 12 which has an outlet 11 for discharging water into the container 10. A float 14 is mounted on a pivot arm 16 which is pivoted on upright 18 by pin 19 to valve 12 and the end 22 of the lever arm 16 controls the operating plunger 21 of the valve 12. Although the valve 12 is shown mounted externally of the container, it is to be realized that this view is primarily schematic and that the valve may be mounted inside of the container. The pivot arm 16 passes through an opening provided in the container in the schematic illustration illustrated in FIG. 1. The float 14 maintains the level of the hot water 101 at a fixed level in the container 10. Mounted in the hot water container 10 is a bellows tube 31 which has a lower portion 29 that mates with the discharge tube 36 as shown in FIGS. 5 and 6. Hot water is discharged through an outlet 24 into a beverage brewer 26 which has an outlet 27 that supplies beverage into a cup 28 as shown in FIG. 1. The upper end 34 of bellows tube 30 receives a dispensing member 37 therein and a rim 33 which engages a rim 38 of dispensing member 37 which is best shown in FIGS. 2 and 3. The dispensing member 37 has an upper rim 38 which bears against a plate 51 that is connected to the wall of the container 10 and has a shaft 41 which extends through an opening formed in the plate 51 as shown. The dispensing member 37 is formed with spoke portions 42, 43, 44 and 45 as shown in FIG. 3 so as to provide openings 46, 47, 48 and 49 through which hot water can pass into the bellows tube when the member 37 is below the upper level of the hot water 101.

A cylindrical guide member 54 is mounted on the top of a plate 51 and shaft 41 passes therethrough and through an opening in wall 56 and is surrounded by a spring 53 which is received in the guide member 54 and has its upper end in engagement with a disk-shaped member 52 formed on the upper end of shaft 41. The spring 53 normally biases the shaft 41 and the bellows tube 31 in the up position relative to the FIGS. so that the rim 38 is sealed against the plate 51 as shown in FIGS. 2 and 5.

A solenoid 61 is mounted by screws 62 as shown in FIGS. 5 and 6 to the container 10 and has a shaft 63 connected to the solenoid which is connected by pivot pin 64 to a lever arm 66 which has one end pivoted by a pin 68 to the frame of the machine. The other end of pivot arm 66 has an actuator 67 which bears against the plate 52 of the shaft 41.

An actuating lead 109 is connected from the solenoid 61 to control 107. Control 107 has a timer 110 which controls the time of actuation of the solenoid 61 when a start button 105 is depressed. A temperature control knob 108 on the control 107 allows the heater to be controlled through lead 100 to maintain the temperature of the water 101 at a desired temperature.

In operation, when water is to be dispensed, the control button 105 is depressed so as to start actuation of the beverage dispenser 26 and the hot water dispenser of the invention which causes the solenoid valve 61 to be energized so that the solenoid moves to the position shown in FIG. 6 such that the actuator 67 depresses shaft 41 thus moving member 37 beneath the surface of the water 101 so that water will pass through the openings 46, 47, 48 and 49 into the bellows tube 31 and out the discharge opening 24. The amount of water dispensed through the bellows tube 31 depends on how long the solenoid 61 is actuated. This time is controlled by the setting of a timer control knob 110 on the control 107. When the solenoid is deactuated, the spring 53 and bellows biases the dispensing member 37 to the up position such as shown in FIG. 5 such that the rim or shoulder 38 rests against plate 51. The seal between the rim 38 and the plate 51 prevents hot water 101 from being dispensed if the dispensing machine is moved or jiggled, for example, and, thus, hot water is dispensed only when the solenoid 61 is energized. The shaft 63 of the solenoid is connected to stop members 98 and 99 which engage the top of the solenoid in the energized position as shown in FIG. 6.

By moving the timer knob 110, the quantity of hot water dispensed can be adjusted to smaller or greater amounts as desired. The heater 102 is controlled by adjusting knob 108 through lead 100.

FIGS. 7 and 8 illustrate a modified form of the invention which includes a dipper valve comprising a flexible pipe or conduit. A tank 111 has an overflow 113 near a top 112. A cover 114 covers the top of the tank 111. A solenoid 116 is connected by holding means 117 to the tank 111. The solenoid 116 has an output shaft 118 which is connected to a connecting bar 121 by connecting pin 120. A return spring 119 biases the shaft 118 to the down position when the solenoid 116 is not energized. A rocker arm 124 is pivotally connected by a pivot pin 127 to frame member 126 and has an extending member 122 which is pivotally connected to the upper end of connecting bar 121 by pivot pin 123. The other end 128 of rocker arm 124 engages a depression formed in plunger 131 which is slidably mounted in a plunger bushing 134 which is mounted in a top portion 132 of the cover 114. The bushing 134 is mounted in a sleeve 133 connected to the top 132 and terminates in a shoulder 138. A dipper valve 141 comprises a flexible tube that has one end 142 connected to a coupling 143 of an output pipe 144 that is mounted in a collar 146 in a lower portion of the tank 111. A stand pipe 148 has an opening above the level of the water 150. The plunger 131 is connected to a disk 136 which is engaged with an upper portion 137 of the dipper valve tube 141 as illustrated. Openings are formed in the member 136 so that water can flow therethrough into the dipper valve tube 141 when the upper end 137 is below the water level 150 as illustrated in FIG. 8, for example.

A float valve 151 is connected to an arm 152 so as to actuate a supply valve, not shown, so as to maintain the water in tank 111 at a substantially constant level.

A control such as control 107 illustrated in FIG. 1 is connected so as to actuate the solenoid 116 such that when the solenoid is actuated the shaft 118 moves up as shown in FIG. 8 to move the connecting bar 121 in the up direction so as to move the right end of the rocker arm 124 downwardly, thus, moving the plunger 131 downwardly to move the upper end 137 of the dipper valve tube 141 below the surface of the water so that water will pass into the upper end 137 of the dipper valve and through the outlet opening 147 into the beverage brewer 26 such as shown in FIG. 1. The control 107 actuates the solenoid 116 for a fixed time as set by the knob 110 so that a fixed quantity of water will pass through the dipper tube 141 and through outlet 147. When the solenoid 116 is de-energized, the return spring 119 moves the member 118 and the connecting bar 121 downwardly to the position shown in FIG. 7 which causes the rocker arm 124 to move counterclockwise relative to the FIGS. so that the upper end 137 of the dipper tube 141 engages the sealing shoulder 138 of the member 133. Since the upper end 137 of the tube 131 is sealed to the member 138, water will not slush or discharge from the container 111 if the container is moved. The dipper valve 141 may be made of any suitable flexible material such as rubber, nylon, neoprene or other suitable materials.

FIG. 9 illustrates a further embodiment of the invention wherein a pipe 161 is pivotally connected by a coupling 162 to an output pipe 163 which is mounted in a bushing 164 of the tank 166. The upper end 180 of the pivotal tube 161 can be moved by the solenoid 167 below the surface of the water 160 so that water will pass through the pivoted tube 161 and the coupling 162 through outlet pipe 163 to the outlet 170. The solenoid 167 has a bracket 168 which is pivotally connected by a pivot pin 171 to a bracket 172 mounted on the frame of the machine. An actuating arm 173 is connected to the armature of the solenoid 167 and has its opposite end 174 coupled by a pivot pin 177 to a bracket 176 attached to the pivoted tube 161. The dash-dot position of the pivoted tube 161 shows the unenergized position of the solenoid 167 where the end 180 of the pivoted tube 161 is above the level of the water 160. When the solenoid 167 is energized, the solenoid causes the actuator arm 173 to move the pivoted tube 161 below the surface of the water 160 so that water will be discharged out the outlet end 170 of the tube 163. The solenoid 167 is controlled by the control 107 shown in FIG. 1 to energize it for a set time determined by the setting of knob 110.

The invention can be used with any liquid and is not limited to hot water. A motor operated device or a solenoid can be used to operate the dispenser.

Although the invention has been described with respect to preferred embodiments, it is not to be so limited as changes and modifications can be made which are within the full intended scope of the invention as defined by the appended claims.

We claim as our invention:

1. Means for dispensing liquid for a beverage brewer comprising, a container means with liquid therein, a supply tube with an outlet end and an input end, an actuating means connected to said supply tube so as to move said input end from a first position above a level of the liquid in said container means to a second position where said input end is below the level of the liquid in said container means so as to deliver liquid from said outlet end.

2. Means for dispensing liquid for a beverage brewer according to claim 1 wherein said actuating means includes a timing means for holding said input end below the level of the liquid for a pre-determined time.

3. Means for dispensing liquid for a beverage brewer according to claim 1 wherein said supply tube is flexible.

4. Means for dispensing liquid for a beverage brewer according to claim 1 including means for maintaining the level of the liquid substantially constant.

5. Means for dispensing liquid for a beverage brewer according to claim 1 including a heater means for heating the liquid in the container means.

6. Means for dispensing liquid for a beverage brewer according to claim 1 including means for sealing the input end of the supply tube when it is in the first position.

7. Means for dispensing liquid for a beverage brewer according to claim 2 wherein said actuating means is a solenoid or motor operated device coupled to said input end of said supply tube so as to move it from the first to second position when the solenoid is energized.

8. Means for dispensing liquid for a beverage brewer according to claim 7 wherein said supply tube is formed with first and second portions which are pivotally connected together and said input end formed in said first portion and said outlet end formed in said second portion.

9. A liquid dispenser comprising, a container which contains liquid that is maintained at a substantially constant level and an opening formed in said container below the level of said liquid, a compressible bellows tube mounted in said container and with its lower end attached to said container about said opening, and means for depressing an upper end of said compressible bellows below the level of said liquid for a selectable time to dispense liquid through said compressible bellows.

10. A liquid dispenser according to claim 9, wherein the upper end of said compressible bellows engages a top wall of said container when said means for depressing the upper end of said bellows is not energized so as to seal the upper end of said bellows to prevent liquid from passing from the container through said bellows.

11. A liquid dispenser according to claim 10 including a dispensing member connected to the upper end of said bellows and formed with a shoulder which engages the top wall of said container when said means for depressing the upper end of said bellows is not energized.

12. A liquid dispenser according to claim 11 wherein said means for depressing the upper end of said compressible bellows comprises a solenoid or motor operated device which has an armature connected to said dispensing member so as to depress the upper end of said bellows.

13. A liquid dispenser according to claim 12 wherein said armature is connected to said dispensing member by a shaft which is connected to said dispensing member and which is driven by said solenoid.

14. A liquid dispenser according to claim 12 including a control connected to said solenoid and said control includes a timer which can be set to selected time durations to energize said solenoids.

15. A liquid dispenser according to claim 14 including a liquid heater mounted in said container so as to heat said liquid.

* * * * *